US011121446B2

(12) United States Patent
De Sousa Pessoa et al.

(10) Patent No.: US 11,121,446 B2
(45) Date of Patent: Sep. 14, 2021

(54) ANTENNA FOR UNDERWATER RADIO COMMUNICATIONS

(71) Applicant: INESC TEC—INSTITUTO DE ENGENHARIA DE SISTEMAS E COMPUTADORES, TECNOLOGIA E CIÊNCIA, Oporto (PT)

(72) Inventors: Luis Manuel De Sousa Pessoa, Oporto (PT); Sofia Isabel Inácio, Oporto (PT); Mário Rui Silveira Pereira, Oporto (PT); Oluyomi Aboderin, Oporto (PT); Henrique Castro Manuel Faria Salgado, Oporto (PT)

(73) Assignee: INSEC TEC—INSTITUTO DE ENGENHARIA DE SISTEMAS E COMPUTADORES, TECNOLOGIA E CIÊNCIA, Oporto (PT)

( * ) Notice: Subject to any disclaimer, the term of this patent is extended or adjusted under 35 U.S.C. 154(b) by 0 days.

(21) Appl. No.: 16/329,546

(22) PCT Filed: Aug. 30, 2017

(86) PCT No.: PCT/IB2017/055217
§ 371 (c)(1),
(2) Date: Feb. 28, 2019

(87) PCT Pub. No.: WO2018/042347
PCT Pub. Date: Mar. 8, 2018

(65) Prior Publication Data

US 2019/0198967 A1 Jun. 27, 2019

(30) Foreign Application Priority Data

Aug. 30, 2016 (EP) ..... 16186459
Nov. 8, 2016 (PT) ..... 109726
Nov. 9, 2016 (EP) ..... 16198054

(51) Int. Cl.
*H01Q 1/04* (2006.01)
*H01Q 3/22* (2006.01)
(Continued)

(52) U.S. Cl.
CPC ..... *H01Q 1/04* (2013.01); *H01Q 3/22* (2013.01); *H01Q 5/30* (2015.01); *H01Q 7/00* (2013.01); *H01Q 9/20* (2013.01); *H01Q 9/285* (2013.01)

(58) Field of Classification Search
CPC .. H01Q 1/04; H01Q 9/20; H01Q 5/30; H01Q 9/285; H01Q 7/00; H01Q 3/22
(Continued)

(56) References Cited

U.S. PATENT DOCUMENTS 10,616,904 B1 * 4/2020 Mirkamali ..... H01Q 21/062
2005/0243014 A1 * 11/2005 Bryan, Jr. ..... H01Q 1/36 343/895

(Continued)

FOREIGN PATENT DOCUMENTS

WO 2016/012738 A1 1/2016

OTHER PUBLICATIONS

Constantine A. Balanis, "Chapter 4—Linear Wire Antennas and Chapter 5—Loop Antennas", Antenna Theory: Analysis and Design, Hoboken, New Jersey, John Wiley and Sons, (Jan. 1, 2005), pp. 151-281, ISBN 978-0-471-66782-7, XP055369936 [Y] 9,13 * equation (4-64); p. 173; figure 4.7 * * equation (5-57); p. 249; figure 5.8.

(Continued)

*Primary Examiner* — Don P Le
(74) *Attorney, Agent, or Firm* — Leason Ellis LLP

(57) ABSTRACT

Method of operating under water an antenna device comprising a frequency-tunable circuit, comprising: tuning said circuit between a first frequency and a second frequency for obtaining a variable directional radiation pattern by the (Continued)

antenna device, to select a directional radiation pattern of the antenna device for improving the radio signal coupling between the antenna devices, in particular for maximizing the radio signal coupling between the two antenna devices, wherein said first frequency and a second frequency are predetermined according to the saltwater-freshwater content of the water such that the directional radiation pattern of the antenna device for one of the two frequencies is directional and the directional pattern of the antenna device for the other of the two frequencies is omnidirectional. Antenna device arranged to periodically tune said circuit to select a directional radiation pattern of the antenna device for improving the radio signal coupling with another antenna device, in particular for maximizing the radio signal coupling with another antenna device.

12 Claims, 10 Drawing Sheets

(51) Int. Cl.

| | |
|---|---|
| ***H01Q 7/00*** | (2006.01) |
| ***H01Q 9/28*** | (2006.01) |
| ***H01Q 5/30*** | (2015.01) |
| ***H01Q 9/20*** | (2006.01) |

(58) Field of Classification Search
USPC ..... 343/719
See application file for complete search history.

(56) References Cited

U.S. PATENT DOCUMENTS

2011/0163926 A1* 7/2011 Lucas ..... H04B 13/02 343/719
2011/0260925 A1* 10/2011 Chirila ..... H01Q 9/04 343/700 MS
2017/0069969 A1* 3/2017 Black ..... H02J 50/20
2017/0310012 A1* 10/2017 Wong ..... H01Q 5/328
2018/0026380 A1* 1/2018 Powell ..... H01Q 9/065 343/893
2018/0102593 A1* 4/2018 Gong ..... H01Q 13/103
2018/0198536 A1* 7/2018 Smolyaninov ..... H04B 13/02
2018/0269595 A1* 9/2018 Lai ..... H01Q 21/28
2019/0089469 A1* 3/2019 Goren ..... H01Q 1/36
2019/0296435 A1* 9/2019 Wu ..... H01Q 9/32
2020/0052369 A1* 2/2020 Kilmer ..... B65D 81/3825

OTHER PUBLICATIONS

Inacio S I et al, "Antenna design for underwater radio communications", OCEANS 2016—Shanghai, IEEE, (Apr. 10, 2016), doi:10.1109/OCEANSAP.2016.7485705, pp. 1-6, XP032909526 [Y] 1-7,9-15 * section IV., VI.; p. 2-p. 4; figures 3, 5, 8.

Filipe Teixeira et al, "Evaluation of IEEE 802.11 Underwater Networks Operating at 700 MHz, 2.4 GHz and 5 GHz", Proceedings of the International Conference on Underwater Networks %Systems, WUWNET '14, New York, New York, USA, (Nov. 12, 2014), doi:10.1145/2671490.2674571, ISBN 978-1-4503-3277-4, pp. 1-5, XP055369689 [AD] 9,13 * section 5.; p. 2-p. 3.

X. Che; et al, "Re-evaluation of RF electromagnetic communication in underwater sensor networks", IEEE Communications Magazine, (20100000), vol. 48, No. 12, doi:doi:10.1109/MCOM.2010.5673085, pp. 143-151.

F. Teixeira; et. al., "Evaluation of IEEE 802.11 Underwater Networks Operating at 700 MHz, 2.4 GHz and 5 GHz", Proceedings of the 9th ACM International Conference on Underwater Networks & Systems, WUWNet, (20140000), vol. 14.

S. Jiang; S. Georgakopoulos, "Electromagnetic wave propagation into fresh water", Journal of Electromagnetic Analysis and Applications, (20110000), vol. 3, No. 07, doi:doi:10.4236/jemaa.2011.37042, p. 261-266, XP055369693.

F. Teixeira, et al., "Evaluation of Underwater IEEE 802.11 Networks at VHF and UHF Frequency Bands using Software Defined Radios," in Proceedings of the International Conference on Underwater Networks & Systems, WUWNET '15, 2015.

* cited by examiner

TABLE I

| | Loop Radius (m) | | |
|---|---|---|---|
| **Conductivity (S/m)** | $f$ = 600 kHz | $f$ = 100 MHz | $f$ = 1 GHz |
| 0 | 9.50 | 0.070 | 0.008 |
| 0.05 | | 0.070 | 0.008 |
| 4 | 3.65 | 0.046 | 0.008 |

Fig. 10

TABLE II

| | Dipole Length (m) | | |
|---|---|---|---|
| **Conductivity (S/m)** | $f$ = 600 kHz | $f$ = 100 MHz | $f$ = 1 GHz |
| 0 | 28.40 | 0.176 | 0.0205 |
| 0.05 | 10.14 | 0.178 | 0.0205 |
| 4 | 11.50 | 0.104 | 0.0196 |

Fig. 11

TABLE III

| $\sigma$ | $f$ = 600 kHz | $f$ = 100 MHz | $f$ = 1 GHz |
|---|---|---|---|
| 0 |  |  |  |
| 0.05 |  |  |  |
| 4 |  |  |  |

TABLE IV

| $\sigma$ | $f$ = 600 kHz | $f$ = 100 MHz | $f$ = 1 GHz |
|---|---|---|---|
| 0 |  |  |  |
| 0.05 |  |  |  |
| 4 |  |  |  |

TABLE V

| f | Radiation Pattern |
|---|---|
| 834 kHz |  |
| 1.68 MHz |  |
| 12.6 MHz |  |
| 19 MHz |  |
| 30 MHz |  |

TABLE VI

| f | Radiation Pattern |
|---|---|
| 286 MHz |  |
| 453 MHz |  |
| 648 MHz |  |
| 1 GHz |  |
| 2.16 GHz |  |

ANTENNA FOR UNDERWATER RADIO COMMUNICATIONS

CROSS-REFERENCE TO RELATED APPLICATIONS

This application is a U.S. National Stage Application under 35 U.S.C. § 371 of International Patent Application No. PCT/IB2017/055217, filed Aug. 30, 2017, which claims priority to European Application No. 16198054.5, filed Nov. 9, 2016, Portugal Application No. 109726, filed Nov. 8, 2016 and European Application No. 16186459.0, filed Aug. 30, 2016, which are hereby incorporated by reference in their respective entireties.

TECHNICAL FIELD

The present disclosure relates to an antenna for underwater radio communications and respective operation method, in particular to an antenna device for underwater radio communications comprising a frequency-tunable circuit, said circuit being tunable between a first frequency and a second frequency for obtaining a variable directional radiation pattern by the antenna device, in order to select a directional radiation pattern of the antenna device for improving the radio signal coupling with another antenna device.

BACKGROUND

The necessity of monitoring aqueous environments and the need for reliable communications between or with underwater vehicles has led to extensive research on underwater wireless communications. Acoustic and optical systems are the most frequently used in those applications, however, both technologies present limitations and disadvantages that radio frequency (RF) systems do not have. The biggest advantage of acoustic systems is the large range that can be achieved, but on the other hand they exhibit poor performance in shallow water, limited bandwidth due to the low frequencies used, may have an impact on marine life and the ambient noise level could be a limiting factor for communication performance.

Although optical systems allow ultra-high bandwidths (on the order of Gbit/s) at very close range, those systems are very susceptible to turbidity and particles fouling, and they require line-of-sight and thus tight alignment, which is a drawback. RF systems can overcome some of the limitations of both acoustic and optical systems. They have the advantage of not being affected by turbidity, operate in non-line-of-sight, are immune to acoustic noise and allow high bandwidths (up to 100 Mbit/s) at very close range.

GENERAL DESCRIPTION

It is disclosed how the main radiation parameters of an underwater antenna, such as the resonant frequency, the input impedance and the radiation pattern, change dramatically with the conductivity of the medium where the antenna is placed. Moreover, the radiation pattern changes with the resonance frequency, that is, in freshwater/seawater the same type of antenna can have different radiation patterns depending if the medium is dielectric or conductive at the antenna's resonant frequency. Therefore, this can be an advantage to achieve the control of the radiation diagram of an antenna placed in a certain type of underwater media, by adjusting the resonant frequency of the antenna, for example, with a simple electronic circuit. This can be exploited to improve underwater communications, for example, between a moving AUV (autonomous underwater vehicle) and a fixed platform, by continuously adjusting the radiation diagram to the most favourable as the AUV moves.

An important application that was investigated in connection with the present disclosure is the implementation of IEEE 802.11 networks in freshwater and seawater at VHF, UHF and SHF (Very, Ultra and Super High Frequency, respectively) bands with the help of software-defined radios. However few analyses of the impact of the antenna design have been presented for those media. In this disclosure, the design of an antenna, in particular dipole antenna, for a RF underwater communication system is described, as a better alternative to current acoustic systems, for short range communications. Moreover, the impact of the conductivity of the medium on the characteristics of the antenna is also assessed by means of simulation and experimental work.

The best media for electromagnetic waves propagation are insulators, where the conductivity is zero ($\sigma=0$ S/m). In those media, electromagnetic waves are not attenuated and therefore they are known as lossless media. If the conductivity of the medium increases, the attenuation of radio waves also increases.

Freshwater conductivity can range from 0.005 to 0.05 S/m, the actual value increasing with salinity and temperature. Thus, seawater has a higher conductivity, with an average of 4 S/m.

In a medium with a conductivity a and at the angular frequency $\omega$, the permittivity becomes complex, with a value of:

$$\varepsilon = \varepsilon_r \varepsilon_0 - j\frac{\sigma}{\omega} \tag{1}$$

where $\varepsilon_0$ is the vacuum permittivity.

The relative permittivity ($\varepsilon_r$) of water depends upon several factors like water temperature, salinity and propagation frequency and it can be described by the Debye model or by the Cole-Cole equation. In this disclosure we considered a relative permittivity value of 81 for both fresh and seawater, since according to the models presented above that is the value of the water permittivity in the frequency range of interest for this work.

Since water is not a magnetic medium the value of its relative permeability is $\mu_r=1$. So the permeability ($\mu$) of water is the same as that of free space.

The propagation of electromagnetic waves, in any medium, is characterized by their propagation constant, $\gamma$, which is given by:

$$\gamma=\sqrt{j\omega\mu(\sigma+j\omega\varepsilon')}=\alpha+j\beta \tag{2}$$

where $\alpha$ (Np/m) and $\delta$ (rad/m) are the attenuation and phase constants, respectively, and w is the angular frequency.

Media where $$\frac{\sigma}{\omega\varepsilon'} \ll 1$$

are considered dielectric media, or insulators. On the other hand, media where $$\frac{\sigma}{\omega\varepsilon'} \gg 1$$

are considered conductors. In FIG. 1 the behaviour of $$\frac{\sigma}{\omega\varepsilon'}$$

is shown as a function of frequency for the two media considered in this work. It can be seen that freshwater becomes a conductor for frequencies below 11.1 MHz and in the case of seawater this transition occurs at 888 MHz.

When an electromagnetic wave propagates in a lossy medium it is attenuated. How it is shown in FIG. 2, that attenuation increases with the frequency and with the conductivity (σ) of the medium, so it is necessary to use low frequencies in order to achieve a reasonable range in RF underwater communication systems.

The wavelength is defined by:

$$\lambda = \frac{2\pi}{\beta} \tag{3}$$

and is represented in FIG. 3 as a function of frequency for three media. It can be seen that the wavelength behaviour changes at the frequency at which the transition from conductive to dielectric medium occurs and from that point it becomes equal to the wavelength in a lossless medium (with the same permittivity).

It is disclosed a method of operating underwater an antenna device comprising a frequency-tunable circuit, said method comprising:

tuning said circuit between a first frequency and a second frequency for obtaining a variable directional radiation pattern (i.e. a variable preferred operation direction) by the antenna device.

An embodiment of the frequency-tunable circuit is a circuit comprising an adjustable-capacity capacitor connected in series or parallel with the antenna such that the resonant frequency of the antenna is adjustable. This adjustment may be carried out by a microprocessor or microcontroller. Another embodiment of the frequency-tunable circuit is a circuit which is tunable by a data processing device executing computer program instructions embodying one of the disclosed methods.

An embodiment, for communicating with another antenna device, comprises tuning said circuit to select a directional radiation pattern of the antenna device for improving the radio signal coupling between the antenna devices, in particular for maximizing the radio signal coupling between the antenna devices.

In an embodiment, the directional radiation pattern of the antenna device for one of the two frequencies is directional and the directional pattern of the antenna device for the other of the two frequencies is omnidirectional.

In an embodiment, said first frequency and a second frequency are predetermined according to the saltwater-freshwater content of the water such that the directional radiation pattern of the antenna device for one of the two frequencies is directional and the directional pattern of the antenna device for the other of the two frequencies is omnidirectional.

In an embodiment, the directional radiation pattern of the antenna device has a 90° shift between the first frequency and the second frequency.

An embodiment comprises continuously tuning said circuit between the first frequency and the second frequency, such that the directional pattern of the antenna device is continuously tuned between the first frequency and the second frequency.

An embodiment comprises tuning said circuit in discrete steps between the first frequency and the second frequency, such that the directional pattern of the antenna device is tuned in discrete steps between the first frequency and the second frequency.

In an embodiment, submerged in fresh water, the first frequency is lower than 11.1 MHz and a second frequency is higher than 11.1 MHz, such that the directional radiation pattern of the antenna device for first frequency is directional and the directional radiation pattern of the antenna device for the second frequency is omnidirectional.

In an embodiment, submerged in salt water, the first frequency is lower than 888 Mhz and the second frequency is higher than 888 MHz, such that the directional radiation pattern of the antenna device for first frequency is directional and the directional radiation pattern of the antenna device for the second frequency is omnidirectional.

In an embodiment, the first frequency is lower than 11.1 Mhz and the second frequency is higher than 888 MHz, such that the directional radiation pattern of the antenna device for first frequency is directional and the directional radiation pattern for second frequency is omnidirectional, independently of the antenna device being submerged in fresh water or salt water.

In an embodiment, the antenna device is a dipole antenna or a loop antenna.

In an embodiment, the antenna device is used in an IEEE 802.11 protocol network.

It is also disclosed an antenna device for underwater radio communications comprising a frequency-tunable circuit, said circuit being tunable between a first frequency and a second frequency for obtaining a variable directional radiation pattern (i.e. a variable preferred operation direction) by the antenna device.

An embodiment is arranged to periodically tune said circuit to select a directional radiation pattern of the antenna device for improving the radio signal coupling with another antenna device, in particular for maximizing the radio signal coupling with another antenna device.

The said periodic tuning can be performed using a sweep, for example, every 10 seconds (see FIG. 8). The tuning must be performed simultaneously by the two antenna devices (emitter and receiver), so that both antenna devices always use the same frequency. In the beginning, a default communication frequency (fa) shall be known by both antenna devices. Periodically both antenna devices will tune their circuits with a frequency sweep (f1-f2) known by both antenna devices, either continuous or discrete. A discrete frequency step can be defined for example between 1 MHz and 5 MHz to be used in the frequency sweep. Using a discrete frequency step facilitates keeping the two antennas in sync during the frequency sweep.

The frequency sweep normally covers from the first frequency (f1) to the second frequency (f2), preferably with a total sweep duration much shorter than the period between said periodic tunings, for example, 100 ms, such that the communication throughout is not substantially affected by the time lost in this. While the tuning is performed, one or both of the antenna devices can register the received signal strength. At the end of the sweep, the results are analysed by one of the antenna devices (the master antenna device) and a decision is made on whether to tune the said circuit to another frequency.

The decision depends on whether a frequency was found where the received signal strength is higher than the received signal strength at the current frequency, or the average of the received signal strength between both antenna devices is higher than the received signal strength at the current frequency. The decision is then communicated by the master antenna device to the other antenna device (slave), normally through said default or currently used frequency, so that both antenna devices will change to the same new frequency (fb). The process is preferably repeated periodically and the new frequency (fb) may then change subsequently to another new frequency (fc), and so on.

According to a method of operating the antenna device, the antenna device is arranged to periodically tune said circuit to select a directional radiation pattern of the antenna device for improving the radio signal coupling with another antenna device, by periodically making a frequency sweep in synchronized frequency between both antennas and selecting a frequency from said frequency sweep that maximizes signal strength coupling between said two antennas. A discrete frequency step can be defined between 1 MHz and 5 MHz to be used in the frequency sweep.

In another possible embodiment, both antenna devices will periodically tune their circuits to the neighbouring frequencies immediately above (f2) and below (f1) the current frequency, by iterative improvements, considering a discrete frequency step that can be defined for example between 1 MHz and 5 MHz (see FIG. 9). In the beginning, a default communication frequency (fa) shall be known by both antenna devices. The tuning period can be for example 10 seconds. The next frequency to be used shall be decided by the master antenna device.

The decision depends on whether the received signal strength at any of the tested frequencies (f1, f2) is higher than the received signal strength at the previous frequency (fa), or the average of the received signal strength between both antenna devices is higher at the tested frequencies than the received signal strength at the previous frequency. The decision is then communicated by the master antenna device to the other antenna device (slave), normally through said default or currently used frequency, so that both antenna devices will change to the same new frequency (fb=f1) which provides a better signal strength. The process is preferably repeated periodically and the new frequency (fb) may then change subsequently to another new frequency (fc), and so on.

According to an alternative method of operating the antenna device, the antenna device is arranged to periodically tune said circuit to select a directional radiation pattern of the antenna device for improving the radio signal coupling with another antenna device, by periodically making a frequency test, in synchronized frequency between both antennas, of a lower frequency than the frequency currently being used and an higher frequency than the frequency currently being used, and selecting a frequency from said lower and higher frequencies that maximizes signal strength coupling between said two antennas. The lower and higher frequencies may have a discrete frequency step that can be defined for example between 1 MHz and 5 MHz above and below the frequency currently being used.

In another embodiment, multiple antenna devices co-exist in a given underwater scenario. In such case, the master antenna device can send information specifically targeted to a given slave antenna device or group of slave antenna devices. Since the physical location of the slave antenna devices can be known to the master antenna device, the master antenna device will select the targeted slave antenna by switching to a frequency where the radiation is substantially directed in the targeted direction, a step that must be preceded with a communication at said default frequency indicating the next frequency to be used, in order to synchronize the transmission.

An embodiment is arranged to continuously tune said circuit between the first frequency and the second frequency, such that the directional pattern of the antenna device is continuously tuned between the first frequency and the second frequency.

An embodiment is arranged to tune said circuit in discrete steps between the first frequency and the second frequency, such that the directional pattern of the antenna device is tuned in discrete steps between the first frequency and the second frequency.

In particular, for fresh water, the first frequency is 834 kHz or 1.68 MHz, and the second frequency is 19 MHz or 30 Mhz. In particular, for fresh water, the first frequency is between 834 kHz-1.68 MHz, and the second frequency is between MHz-30 Mhz.

In particular, for salt water, the first frequency is 286 MHz or 453 MHz, and the second frequency is 1 GHz or 2.16 GHz. In particular, for salt water, the first frequency is between 286 MHz-453 MHz, and the second frequency is between 1 GHz-2.16 GHz.

BRIEF DESCRIPTION OF THE DRAWINGS

The following figures provide preferred embodiments for illustrating the description and should not be seen as limiting the scope of invention.

as a function of frequency for the two media considered in this work ($\sigma$=0.05 S/m and $\sigma$=4 S/m).

Figure 2:
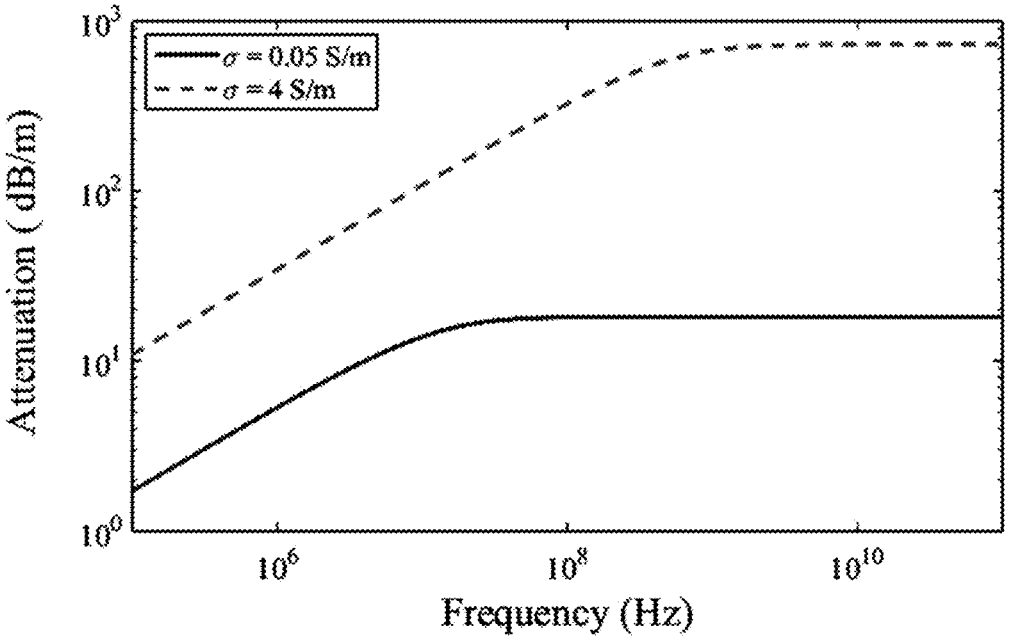

FIG. 2: Attenuation of an electromagnetic wave propagating in two different media ($\sigma$=0.05 S/m and $\sigma$=4 S/m).

Figure 3:
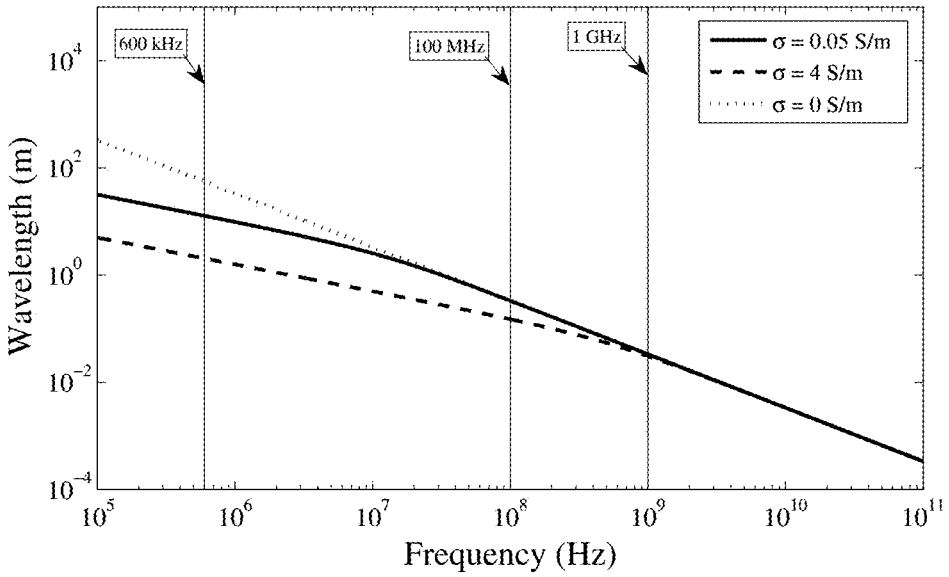

FIG. 3: Wavelength of an electromagnetic wave propagating in three different media with $\varepsilon'$=81 ($\sigma$=0 S/m, $\sigma$=0.05 S/m and $\sigma$=4 S/m).

Figure 4:
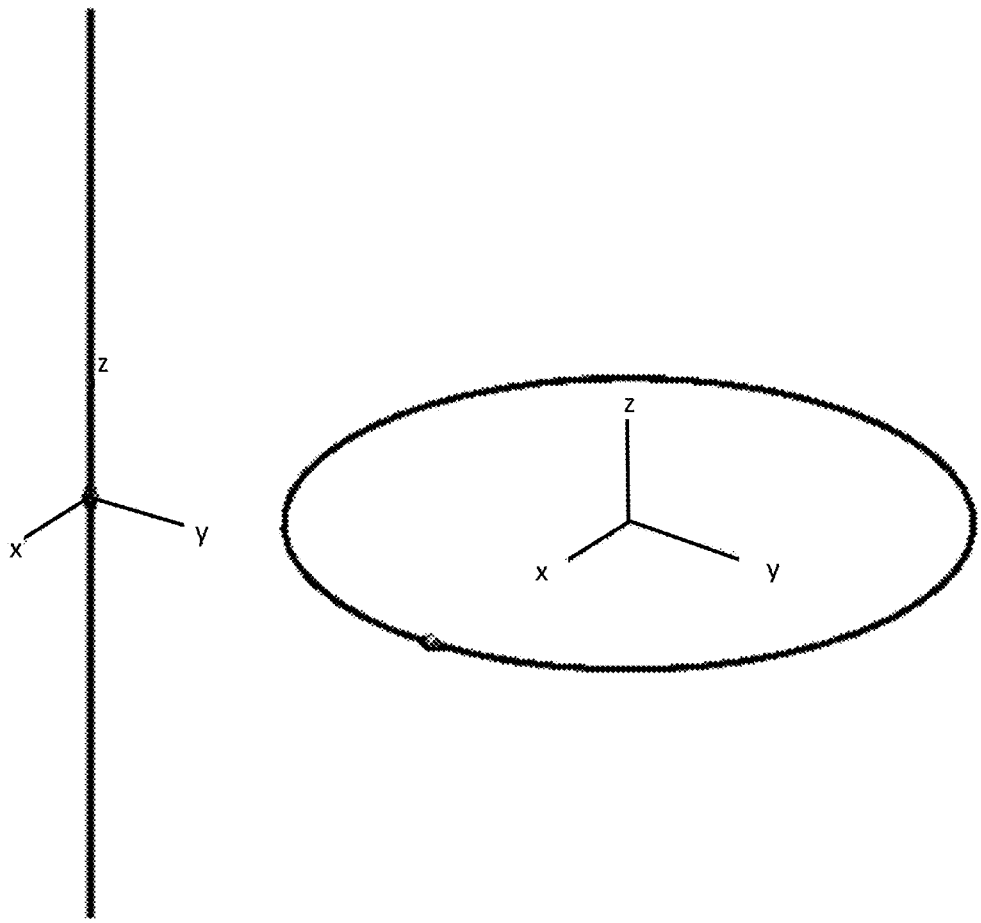

FIG. 4: Analysed antennas: dipole and loop.

Figure 5:
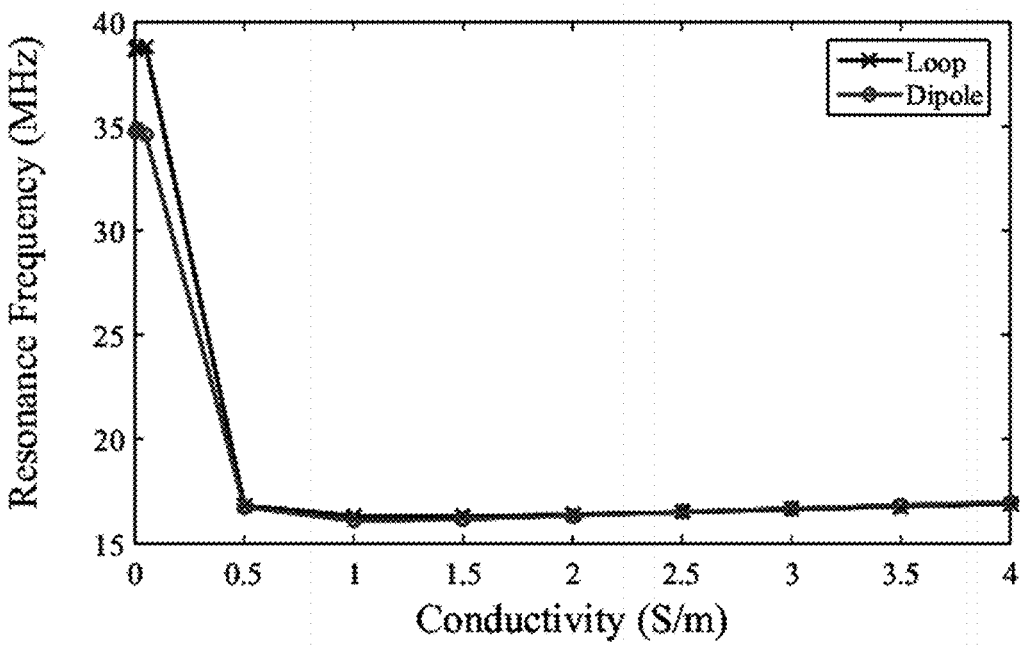

FIG. 5: Dependency of resonance frequency on the water conductivity.

Figure 6:
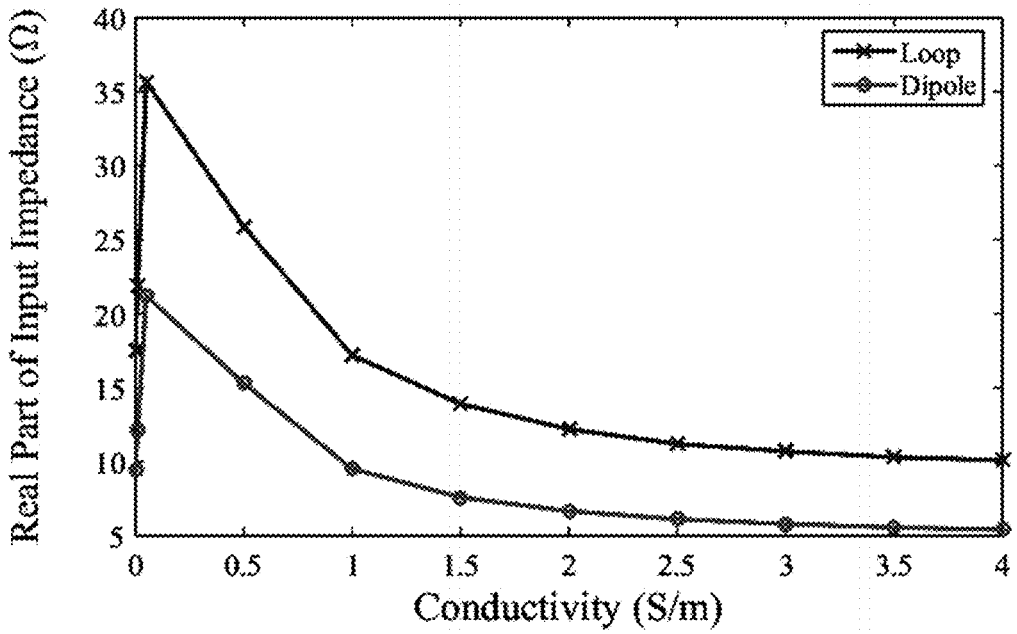

FIG. 6: Dependency of real part of input impedance at resonance on the water conductivity.

Figure 7:
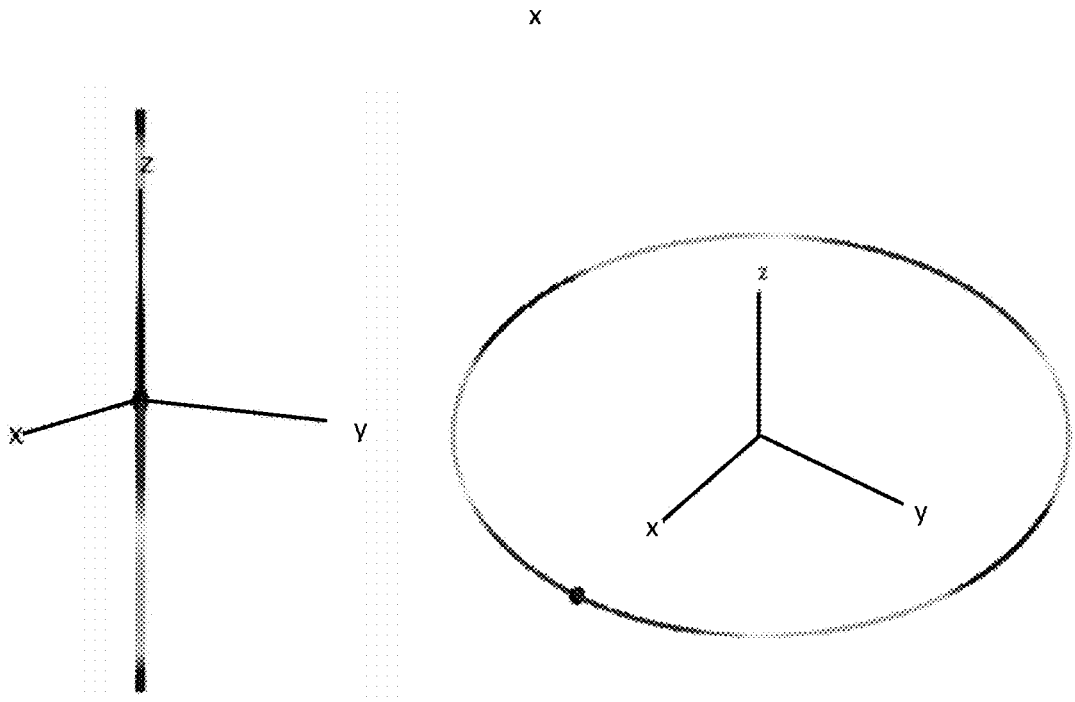

FIG. 7: Current distribution in antennas at the resonant frequency: dipole and loop.

Figure 8:
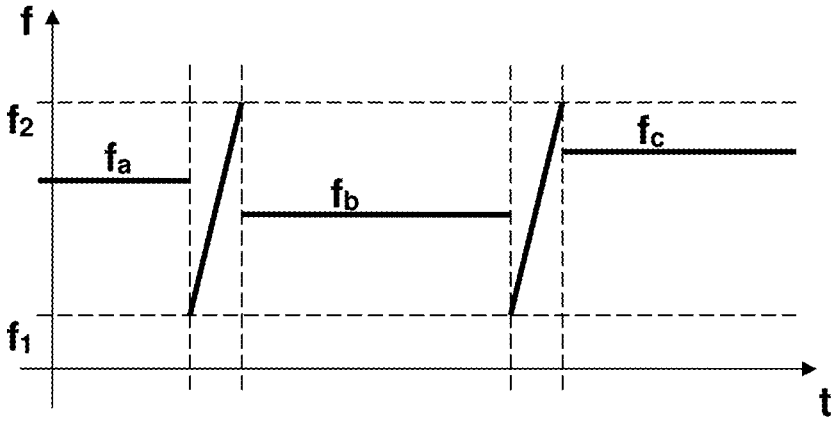

FIG. 8: Frequency adjustment method by periodic frequency sweep.

Figure 9:
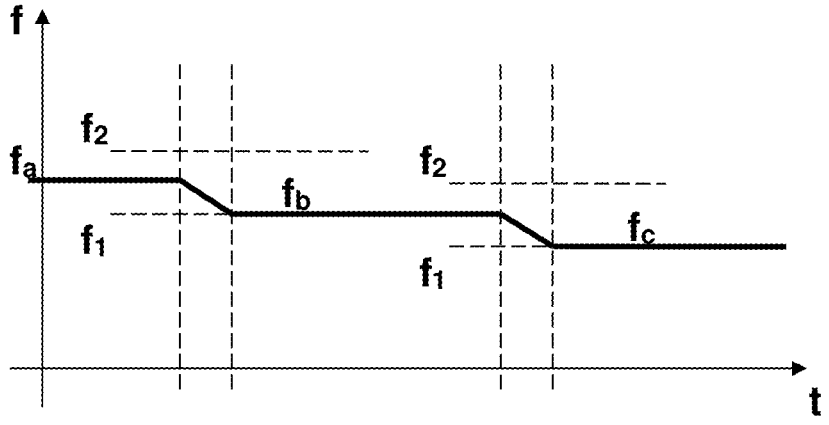

FIG. 9: Frequency adjustment method by iterative frequency improvements.

FIG. 10 comprises Table I: Dimensions of the loop antenna for the three different types of media at three different frequencies.

FIG. 11 comprises Table II: Dimensions dipole antenna for the three different types of media at three different frequencies.

Figure 12:
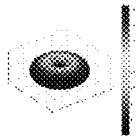
Figure 12:
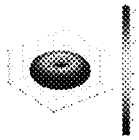
Figure 12:
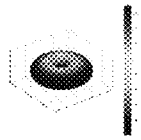
Figure 12:
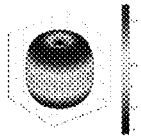
Figure 12:
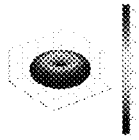
Figure 12:
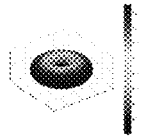
Figure 12:
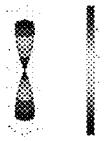
Figure 12:
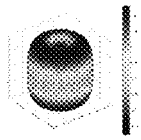
Figure 12:
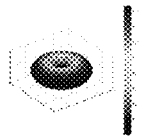

FIG. 12 comprises Table III: Radiation pattern for the dipole antenna for the three different media and for the three different frequencies.

Figure 13:
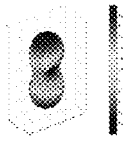
Figure 13:
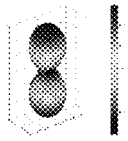
Figure 13:
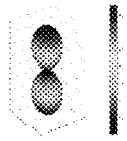
Figure 13:
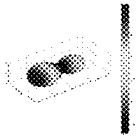
Figure 13:
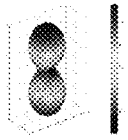
Figure 13:
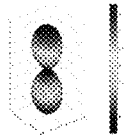
Figure 13:
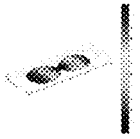
Figure 13:
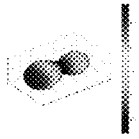
Figure 13:
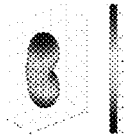

FIG. 13 comprises Table IV: Radiation pattern for the loop antenna for the three different media and for the three different frequencies.

Figure 14:
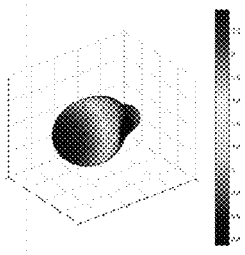
Figure 14:
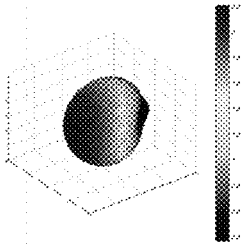
Figure 14:
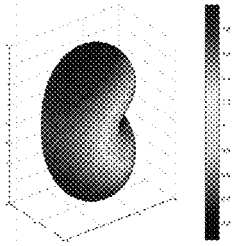
Figure 14:
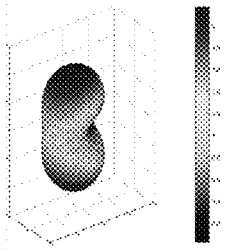
Figure 14:
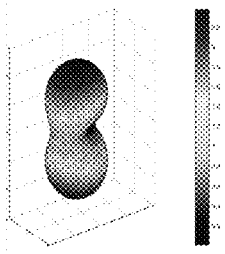

FIG. 14 comprises Table V: Radiation patterns for the loop antenna near the transition from conductive to dielectric media in freshwater.

Figure 15:
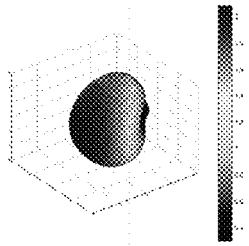
Figure 15:
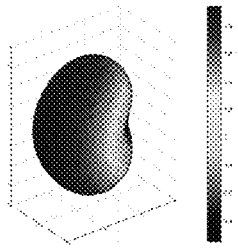
Figure 15:
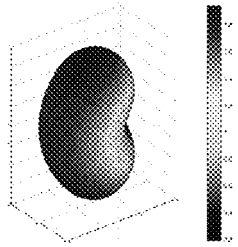
Figure 15:
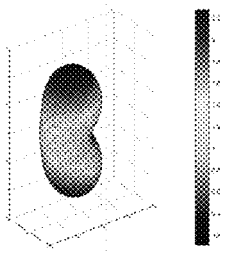
Figure 15:
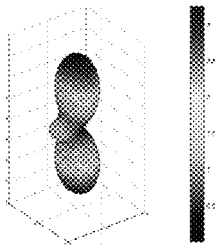

FIG. 15 comprises Table VI: Radiation patterns for the loop antenna near the transition from conductive to dielectric media in seawater.

DETAILED DESCRIPTION

We have assessed through simulation, in FEKO 3D electromagnetic simulator, the performance of two different antennas embodying the disclosure in terms of resonance frequency, input impedance and radiation pattern. The antennas are a loop antenna with a radius of 16 cm and a 50 cm length dipole antenna. The two antennas are depicted in FIG. 4 and consisted of a simple 3 mm thick cooper wire, covered with an insulator with a thickness of 50 μm and a relative permittivity of 3.

We performed an extensive analysis of this two antennas in terms of their radiation characteristics in underwater media, in particular an analysis of resonant frequency and input impedance. FIG. 6 and FIG. 7 show the dependency of two major antenna parameters as a function of water conductivity, namely the resonant frequency and the real part of the impedance at that frequency, respectively. From these figures it is clearly seen that both the resonant frequency and the input impedance of both antennas change dramatically with the conductivity of water. From these results we readily conclude that the same physical antenna, without further adaptations or circuits, will not normally be suitable for both fresh and seawater environments, as the resonance frequency is relatively different. Moreover, from FIG. 7 we can also conclude that depending on the conductivity of water, different matching networks must be designed, for an efficiently use of the antennas.

FIG. 7 shows the current distribution in both antennas at the resonant frequency. In this disclosure it is considered a $\lambda/2$ dipole and a large loop with a circumference length being $\lambda$.

In an embodiment, we analyse the near field of both antennas through simulations in FEKO. Simulations for the near field were obtained as far away from the antennas as possible, with the intention of determining the radiation pattern, since it is impossible to measure directly the far field pattern in lossy media.

Figure 1:
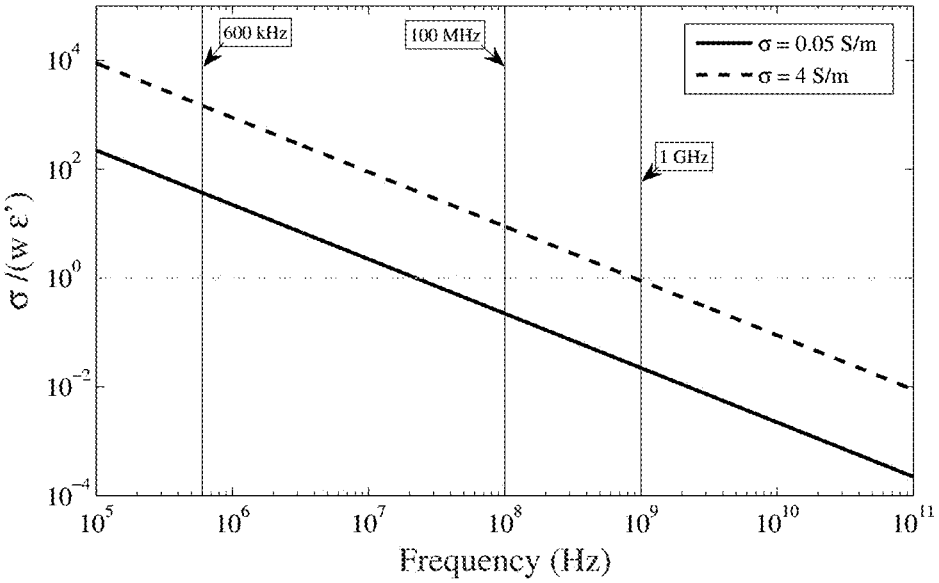
FIG. 1: Behaviour of $$\frac{\sigma}{\omega\varepsilon'}$$

The radiation pattern was obtained for three frequencies (600 kHz, 100 MHz, 1 GHz) and for three different media: $\sigma$=0 S/m, $\sigma$=0.05 S/m and $\sigma$=4 S/m (with $\varepsilon'$=81). The frequencies were chosen in order for all the media to be dielectric at one frequency (f=1 GHz), another frequency in which only seawater was a conductive medium (f=100 MHz) and finally a frequency at which both fresh and seawater were conductive (f=600 kHz), as shown in FIG. 1.

The dimensions of both antennas were adjusted to make them resonant at the three frequencies, giving them a current distribution equal to FIG. 7. The dimensions are shown in TABLE I (FIG. 10) and in TABLE II (FIG. 11) for the loop and dipole, respectively, for the three media considered and for the three frequencies analysed.

TABLE III (FIG. 12) and TABLE IV (FIG. 13) show the radiation patterns for the loop antenna and for the dipole, respectively, with the antennas placed in the same orientation as in FIG. 4. Again we see the influence of the water conductivity on the performance of the antenna. In a dielectric medium the radiation pattern maximums are oriented in the z+ and z− directions, whereas in a conductive medium they are shifted by 90°, in the case of the loop antenna. A change in the radiation pattern can be observed also for the dipole when the medium becomes conductive. Other antenna types, and respective combinations, will have the corresponding radiation behaviours, such that the disclosure is not limited to dipole or loop antennas, these being illustrative embodiments.

To better understand the change of the radiation pattern, we made an analysis near the frequency of transition between a conductive/dielectric media. In Table V (FIG. 14) are shown the radiation patterns for the loop antenna in freshwater, close to 11 MHz. In Table VI (FIG. 15) are shown the radiation patterns for the same antenna in seawater near 888 MHz (according to FIG. 1). It is easy to see that the evolution of the radiation pattern is very similar in both cases when the media is transitioning between conductive and dielectric.

In this disclosure, the performance of two antennas in underwater media was analysed. It was seen that the main radiation parameters, such as the resonant frequency, the input impedance and the radiation pattern, change dramatically with the conductivity of the medium where the antenna is placed. Moreover, the radiation pattern changes with the resonance frequency, that is, in freshwater/seawater the same type of antenna can have different radiation patterns depending if the medium is dielectric or conductive at the antenna's resonant frequency. Therefore, we can take advantage of this fact to achieve the control of the radiation diagram of an antenna placed in a certain type of underwater media, by adjusting the resonant frequency of the antenna with a simple electronic circuit. This can be exploited to improve underwater communications, for example, between a moving AUV and a fixed platform, by continuously adjusting the radiation diagram to the most favourable as the AUV moves.

The term "comprising" whenever used in this document is intended to indicate the presence of stated features, integers, steps, components, but not to preclude the presence or addition of one or more other features, integers, steps, components or groups thereof.

It is to be appreciated that certain embodiments of the disclosure as described herein may be incorporated as code (e.g., a software algorithm or program) residing in firmware and/or on computer useable medium having control logic for enabling execution on a computer system having a computer processor, such as any of the servers described herein. Such a computer system typically includes memory storage configured to provide output from execution of the code which configures a processor in accordance with the execution. The code can be arranged as firmware or software, and can be organized as a set of modules, including the various modules and algorithms described herein, such as discrete code modules, function calls, procedure calls or objects in an object-oriented programming environment. If implemented using modules, the code can comprise a single module or a plurality of modules that operate in cooperation with one another to configure the machine in which it is executed to perform the associated functions, as described herein.

The disclosure should not be seen in any way restricted to the embodiments described and a person with ordinary skill in the art will foresee many possibilities to modifications thereof. The above described embodiments are combinable. The following claims further set out particular embodiments of the disclosure.

The following references, should be considered herewith incorporated in their entirety:

[1] X. Che, I. Wells, G. Dickers, P. Kear, and X. Gong, "Re-evaluation of RF electromagnetic communication in underwater sensor networks," IEEE Communications Magazine, vol. 48, no. 12, pp. 143-151, 2010.

[2] F. Teixeira, P. Freitas, L. Pessoa, R. Campos, and M. Ricardo, "Evaluation of IEEE 802.11 Underwater Networks Operating at 700 MHz, 2.4 GHz and 5 GHz," in Proceedings of the 9th ACM International Conference on Underwater Networks & Systems, WUWNet '14, 2014.

[3] F. Teixeira, J. Santos, L. Pessoa, M. Pereira, R. Campos, and M. Ricardo, "Evaluation of Underwater IEEE 802.11 Networks at VHF and UHF Frequency Bands using Software Defined Radios," in Proceedings of the International Conference on Underwater Networks & Systems, WUWNET '15, 2015.

[4] S. Jiang and S. Georgakopoulos, "Electromagnetic wave propagation into fresh water," Journal of Electromagnetic Analysis and Applications, vol. 3, no. 07, p. 261, 2011.

The invention claimed is:

1. A method of operating under water an antenna device connected to a frequency-tunable circuit, said circuit being arranged to be tunable to select between a first frequency and a second frequency, said method comprising:

tuning said circuit between the first frequency and the second frequency for obtaining a variable directional radiation pattern by the antenna device, wherein said first frequency and a second frequency are predetermined according to the saltwater-freshwater content of the water, wherein the directional radiation pattern of the antenna device for one of the two frequencies is directional and the directional pattern of the antenna device for the other of the two frequencies is omnidirectional, wherein said directional radiation patterns are independent of the antenna device being submerged in fresh water or salt water, wherein the first frequency is lower than 11.1 MHz and the second frequency is higher than 888 MHz, and wherein the antenna device is a dipole or a loop antenna.

2. The method according to the claim 1, wherein tuning said circuit comprises selecting a directional radiation pattern of the antenna device for improving a radio signal coupling between the antenna device and another antenna device.

3. The method, according to claim 1, wherein a radiation pattern maximum of the directional radiation pattern of the antenna device has a 90° shift between the first frequency and the second frequency.

4. The method according to claim 1, wherein the tuning said circuit comprises tuning in discrete steps between the first frequency and the second frequency whereby the directional pattern of the antenna device is tuned in discrete steps between the first frequency and the second frequency.

5. The method according to claim 1, wherein the water is fresh water, such that the directional radiation pattern of the antenna device for first frequency is directional and the directional radiation pattern of the antenna device for the second frequency is omnidirectional.

6. The method according to claim 1, wherein the water is salt water, such that the directional radiation pattern of the antenna device for first frequency is directional and the directional radiation pattern of the antenna device for the second frequency is omnidirectional.

7. An antenna arrangement for underwater radio communications comprising a frequency-tunable circuit connected to an antenna device, said circuit being arranged to be tunable to select between a first frequency and a second frequency for obtaining a variable directional radiation pattern by the antenna device, wherein said frequencies are predetermined according to the saltwater-freshwater content of the water, wherein the directional radiation pattern of the antenna device for one of the two frequencies is directional and the directional pattern of the antenna device for the other of the two frequencies is omnidirectional, when the antenna device is underwater in water of said saltwater-freshwater content, wherein said directional radiation patterns are independent of the antenna device being submerged in fresh water or salt water, wherein the first frequency is lower than 11.1 MHz and the second frequency is higher than 888 MHz, and wherein the antenna device is a dipole or loop antenna.

8. The antenna arrangement according to claim 7, arranged to periodically tune said circuit to select a directional radiation pattern of the antenna device for improving the radio signal coupling with another antenna device.

9. The antenna arrangement, according to claim 7, wherein the radiation pattern maximum of the directional radiation pattern of the antenna device has a 90° shift between the first frequency and the second frequency when the device is submerged in freshwater or saltwater.

10. The antenna arrangement according to claim 7, wherein the antenna device is an IEEE 802.11 protocol network antenna.

11. A non-transitory storage media including program instructions for implementing a method of operating under water an antenna device, the program instructions including instructions that when executed by a data processing device cause it to carry out the method of claim 1.

12. The antenna arrangement of claim 10, further comprising a non-transitory storage media including program instructions for implementing a method of operating under water an antenna device, the program instructions including instructions executable to carry out the method of claim 1.

* * * * *